US006311512B1

(12) United States Patent
Fung et al.

(10) Patent No.: US 6,311,512 B1
(45) Date of Patent: Nov. 6, 2001

(54) REFRIGERATED MERCHANDISER SYSTEM

(75) Inventors: Kwok Kwong Fung, Granger, IN (US); Eugene Duane Daddis, Jr.; Robert Hong Leung Chiang, both of Manlius, NY (US)

(73) Assignee: Carrier Corporation, Syracuse, NY (US)

( * ) Notice: Subject to any disclaimer, the term of this patent is extended or adjusted under 35 U.S.C. 154(b) by 0 days.

(21) Appl. No.: 09/573,308

(22) Filed: May 18, 2000

(51) Int. Cl.[7] ..... F25D 21/00
(52) U.S. Cl. ..... 62/272; 62/210
(58) Field of Search ..... 62/255, 256, 210, 62/217, 272

(56) References Cited

U.S. PATENT DOCUMENTS

| | | | | |
|---|---|---|---|---|
| 3,577,744 | | 5/1971 | Mercer | 62/576 |
| 3,681,896 | | 8/1972 | Velkoff | 55/107 |
| 3,800,551 | * | 4/1974 | Weibel, Jr. et al. | 62/217 |
| 4,272,969 | | 6/1981 | Schwitzgebel | 62/419 |
| 4,644,758 | * | 2/1987 | Maehara et al. | 62/256 |
| 5,743,098 | | 4/1998 | Behr | 62/80 |
| 5,832,995 | * | 11/1998 | Chiang et al. | 165/179 |

* cited by examiner

*Primary Examiner*—William Doerrler
*Assistant Examiner*—Mohammad M. Alil
(74) *Attorney, Agent, or Firm*—William W. Habelt

(57) ABSTRACT

A refrigerated merchandiser system (10) includes a compressor (20), a condenser (30), a display case (100) having an evaporator (40), an expansion device (50) and an evaporator pressure control device (60) connected in a closed refrigerant circuit via refrigerant lines (12, 14, 16 and 18). The evaporator pressure control device (60) operates to maintain the pressure in the evaporator at a predetermined pressure so as to maintain the temperature of the refrigerant expanding from a liquid to a vapor within the evaporator (40) in the range of about 27 degrees F to about 32 degrees F. The evaporator (40) has a fin and tube heat exchanger coil having a relatively high fin density of at least 5 fins per inch, and most advantageously in the range of 6 to 15 fins per inch.

8 Claims, 2 Drawing Sheets

REFRIGERATED MERCHANDISER SYSTEM

TECHNICAL FIELD

The present invention relates generally to refrigerated merchandiser systems and, more particularly, to the operation of a refrigerated, medium temperature, food merchandiser system, so as to significantly reduce defrost requirements.

BACKGROUND OF THE INVENTION

In conventional practice, supermarkets and convenient stores are equipped with display cases, which may be open or provided with doors, for presenting fresh food or beverages products to customers, while maintaining the fresh food and beverages in a refrigerated environment. Typically, cold, moist air is provided to the product display zone of each display case by passing air over the heat exchange surface of an evaporator coil disposed within the display case in a region separate from the product display zone so that the evaporator is out of customer view. A suitable refrigerant, such as for example R-404A refrigerant, is passed through the heat exchange tubes of the evaporator coil. As the refrigerant evaporates within the evaporator coil, heat is absorbed from the air passing over the evaporator so as to lower the temperature of the air.

A refrigeration system is installed in the supermarket and convenient store to provide refrigerant at the proper condition to the evaporator coils of the display cases within the facility. All refrigeration systems comprise at least the following components: a compressor, a condenser, at least one evaporator associated with a display case, a thermostatic expansion valve, and appropriate refrigerant lines connecting these devices in a closed circulation circuit. The thermostatic expansion valve is disposed in the refrigerant line upstream with respect to refrigerant flow of the inlet to the evaporator for expanding liquid refrigerant. The expansion valve functions to meter and expand the liquid refrigerant to a desired lower pressure, selected for the particular refrigerant, prior to entering the evaporator. As a result of this expansion, the temperature of the liquid refrigerant also drops significantly. The low pressure, low temperature liquid evaporates as it absorbs heat in passing through the evaporator tubes from the air passing over the surface of the evaporator. Typically, supermarket and grocery store refrigeration systems include multiple evaporators disposed in multiple display cases, an assembly of a plurality of compressors, termed a compressor rack, and one or more condensers.

Additionally, in certain refrigeration systems, an evaporator pressure regulator (EPR) valve is disposed in the refrigerant line at the outlet of the evaporator. The EPR valve functions to maintain the pressure within the evaporator above a predetermined pressure set point for the particular refrigerant being used. In refrigeration systems used to chill water, it is known to set the EPR valve so as to maintain the refrigerant within the evaporator above the freezing point of water. For example, in a water chilling refrigeration system using R-12 as refrigerant, the EPR valve may be set at a pressure set point of 32 psig (pounds per square inch, gage) which equates to a refrigerant temperature of 34 degrees F.

As in conventional practice, evaporators in refrigerated food display systems generally operate with refrigerant temperatures below the frost point of water, frost will form on the evaporators during operation as moisture in the cooling air passing over the evaporator surface comes in contact with the evaporator surface. As frost builds up on the evaporator surface, the performance of the evaporator deteriorates and the free flow of air through the evaporator becomes restricted and in extreme cases halted. Consequently, it is customary to equip a refrigerated food display system with a defrost system which may be selectively or automatically operated, typically one to four times in a 24-hour period for up to one hundred and ten minutes each cycle, to remove the frost formation from the evaporator surface.

Conventional methods for defrosting evaporators on refrigerated food display systems include passing air over an electric heating element and thence over the evaporator, passing ambient temperature store air over the evaporator, and passing hot refrigerant gas through the refrigerant lines through the evaporator. The latter method, commonly referred to as hot gas defrost, hot gaseous refrigerant from the compressor passes in reverse direction through the evaporator. The hot gaseous refrigerant condenses in the frosted evaporator and returns as condensed liquid to an accumulator, rather than directly to the compressor to prevent compressor flooding and possible damage. The latent heat given off by the condensing hot gaseous refrigerant melts the frost off the evaporator.

Although effective to remove the frost and thereby reestablishing proper air flow evaporator operating conditions, defrosting the evaporator has drawbacks. As the cooling cycle must be interrupted during the defrost period, the product temperature rises during the defrost. Thus, product in the display merchandiser may be repeatedly subject to alternate periods of cooling and warming. Also, additional controls must be provided on the refrigeration system to properly sequence defrosting cycles, particularly in stores having multiple refrigerated merchandisers to ensure that all merchandisers are not in defrost cycles simultaneously.

According, it would be desirable to operate a refrigerated merchandiser, in particular a medium temperature merchandiser, in a continuous frost-free state without the necessity of employing a defrost cycle. U.S. Pat. No. 3,577,744, Mercer, for example, discloses a method of operating an open refrigerated display case in which the product zone remains frost-free and in which the evaporator coils remain ice-free. In the disclosed method, a small secondary evaporator unit is utilized to dry ambient air for storage under pressure. The cooled, dehydrated air is then metered into the primary cooling air flow and passed in intimate contact with the surfaces in the product zone. As the air in intimate contact with the surfaces is dehydrated, no frost is formed on the surfaces in the product zone.

U.S. Pat. No. 3,681,896, Velkoff, discloses controlling the formation of frost in heat exchangers, such as evaporators, by applying an electrostatic charge to the air-vapor stream and to water introduced into the stream. The charged water droplets induce coalescence of the water vapor in the air and these charged vapor and droplets collect on the surface of oppositely charged plates disposed upstream of the heat exchanger coils. Thus, the cooling air passing over the heat exchanger coils is relatively moisture-free and frost formation on the heat exchanger coils does not occur.

U.S. Pat. No. 4,272,969, Schwitzgebel, discloses a refrigerator for maintaining a high humidity, frost-free environment. An additional throttling element, for example a suction-pressure-regulating valve or a capillary pipe, is installed in the return line between the evaporator outlet and the compressor for throttling the flow to maintain the evaporator surface above 0 degrees Centigrade. Additionally, the evaporator surface is sized far bigger than the evaporator surface used in conventional refrigerators of the same refrigerated volume, preferably twice the size of a conventional evaporator, and possibly ten times the size of a conventional evaporator.

SUMMARY OF THE INVENTION

It is an object of this invention to provide a method of operating a refrigerated merchandiser system in a relatively frost-free mode, whereby defrost requirements are significantly reduced.

It is an object of another aspect of this invention to provide a refrigerated merchandiser system capable of operating relatively frost-free.

It is another object of this invention to provide a refrigerated merchandiser system having a display case evaporator having a compact heat exchanger.

In accordance with the apparatus aspect of the present invention, a refrigerated merchandiser system includes a compressor, a condenser, a display case having an evaporator, an expansion device and an evaporator pressure control device, all connected in a closed refrigerant circuit. The evaporator pressure control device operates to maintain the pressure in the evaporator at a predetermined pressure so as to maintain the temperature of the refrigerant expanding from a liquid to a vapor within the evaporator in the range of about 27 degrees F to about 32 degrees F. The evaporator has a fin and tube heat exchanger coil having a relatively high fin density of at least 5 fins per inch, and most advantageously in the range of 6 to 15 fins per inch.

In accordance with another aspect of the present invention, a method is provided of operating a refrigerated merchandiser system including a display case having an evaporator having a fin and tube heat exchanger, a compressor, a condenser, and an expansion device upstream of and in operative association with the evaporator, all connected in a refrigeration circuit containing a refrigerant. An evaporator pressure control valve is disposed in the refrigeration circuit downstream of and in operative association with the evaporator. The evaporator pressure control valve is set at a predetermined set point pressure for the refrigerant to maintain the refrigerant temperature within the evaporator in the range of about 27 degrees F to about 32 degrees F. The evaporator heat exchanger is designed with a fin density of at least 5 fins per inch, and most advantageously in the range of 6 fins per inch to 15 fins per inch.

DESCRIPTION OF THE DRAWINGS

For a further understanding of the present invention, reference should be made to the following detailed description of a preferred embodiment of the invention taken in conjunction with the accompanying drawings wherein.

DESCRIPTION OF THE PREFERRED EMBODIMENT

For purposes of illustration, the commercial refrigeration system of the present invention is depicted as having a single display case with a single evaporator, a single condenser, and a single compressor. It is to be understood that the principles of the present invention are applicable to various embodiments of commercial refrigeration systems having single or multiple display cases with one or more evaporators per case, single or multiple condensers and/or single or multiple compressor arrangements.

Figure 1:
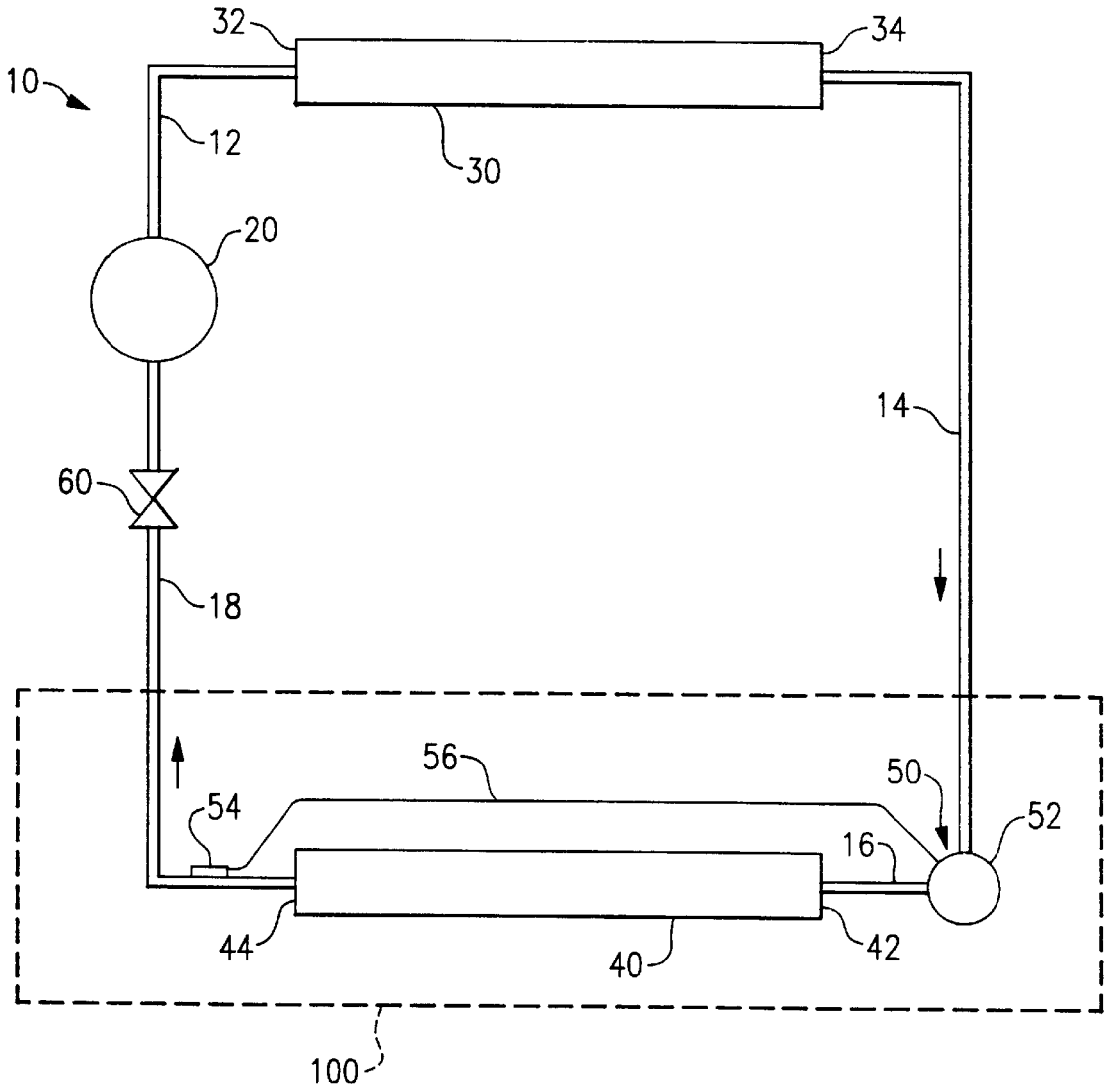
FIG. 1 is a schematic diagram of a commercial refrigeration system using the present invention.
Figure 2:
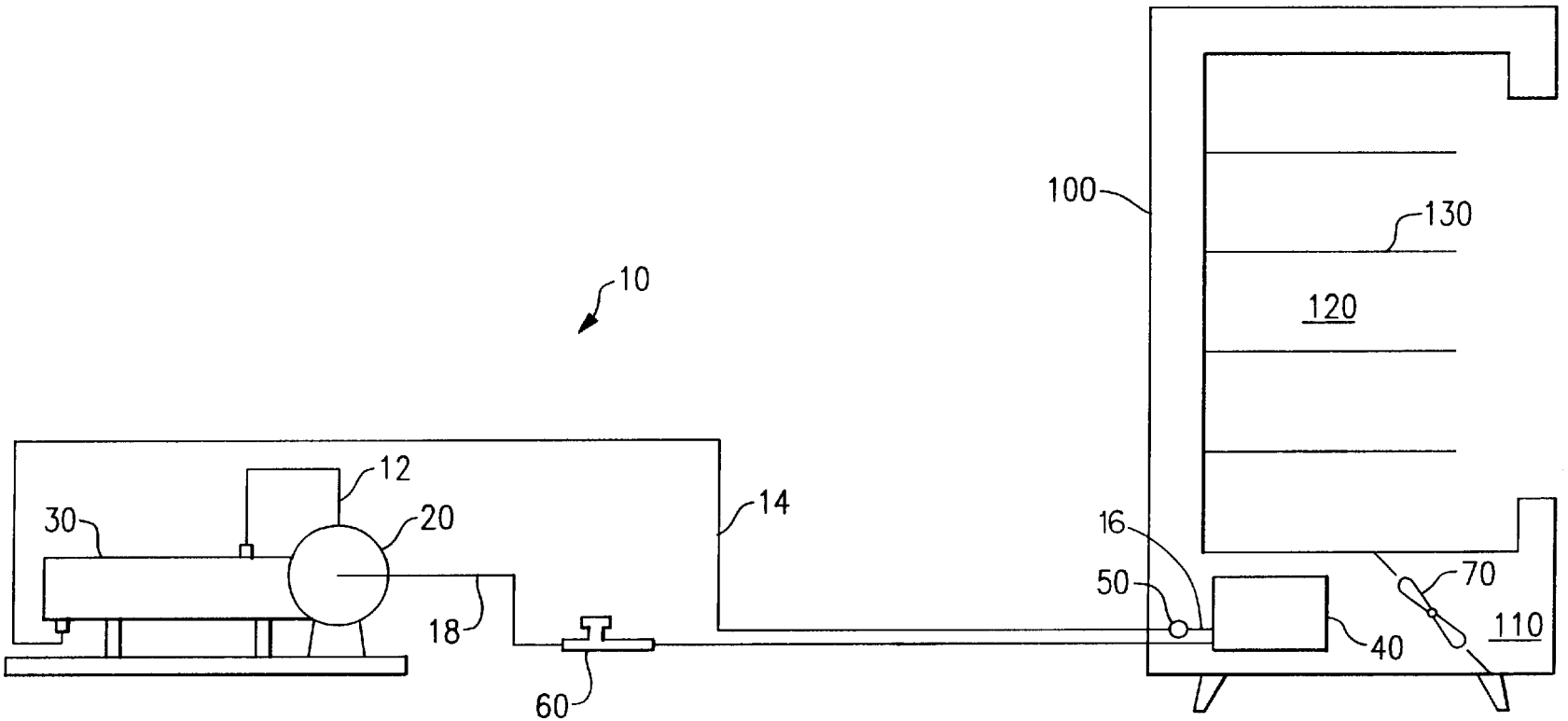
FIG. 2 is an elevation view of a representative layout of the commercial refrigeration system shown schematically in FIG. 1.

Referring now to FIGS. 1 and 2, the refrigerated merchandiser system 10 of the present invention includes five basic components: a compressor 20, a condenser 30, an evaporator 40, an expansion device 50 and an evaporator pressure control device 60 connected in a closed refrigerant circuit via refrigerant lines 12, 14, 16 and 18. However, it is to be understood that the present invention is applicable to refrigeration systems having additional components, controls and accessories. The outlet or high pressure side of the compressor 20 connects via refrigerant line 12 to the inlet 32 of the condenser 30. The outlet 34 of the condenser 30 connects via refrigerant line 14 to the inlet of the expansion device 50. The outlet of the expansion device 50 connects via refrigerant line 16 to the inlet 42 of the evaporator 40 disposed within the display case 100. The outlet 44 of the evaporator 40 connects via refrigerant line 18, commonly referred to as the suction line, back to the suction or low pressure side of the compressor 20.

The evaporator 40 is disposed within the display case 100 in a compartment 110 separate from and beneath the product display area 120. As in convention practice, air is circulated, either by natural circulation or by means of a fan 70, through the evaporator 40 and thence through the product display area 120 to maintain products stored on the shelves 130 in the product display area 120 at a temperature below the ambient temperature in the region of the store near the display case 100. As the air passes through the evaporator 40, it pass over the external surface of the fin and tube heat exchanger coil in heat exchange relationship with the refrigerant passing through the tubes of the exchanger coil.

The expansion device 50, which although shown located within the display case 100 may be mounted at any location in the refrigerant line 14, serves to meter the correct amount of liquid refrigerant flow into the evaporator 40. As in conventional practice, the evaporator 40 functions most efficiently when as full of liquid refrigerant as possible without passing liquid refrigerant out of the evaporator into suction line 18. Although any particular form of conventional expansion device may be used, the expansion device 50 most advantageously comprises a thermostatic expansion valve (TXV) 52 having a thermal sensing element, such as a sensing bulb 54 mounted in thermal contact with suction line 18 downstream of the outlet 44 of the evaporator 40. The sensing bulb 54 connects back to the thermostatic expansion valve 52 through a conventional capillary line 56.

The evaporator pressure control device 60, which most advantageously comprises a conventional evaporator pressure regulator valve (EPRV), operates to maintain the pressure in the evaporator at a preselected desired pressure by modulating the flow of refrigerant leaving the evaporator through the suction line 18. By maintaining the pressure in the evaporator at that desired pressure, the temperature of the refrigerant expanding from a liquid to a vapor within the evaporator 40 will be maintained at a specific temperature associated with the particular refrigerant passing through the evaporator.

In combination, these two valves function to control evaporator performance, with TXV 52 functioning to maintain the proper level of liquid within the evaporator 40 and EPRV 60 functioning to keep the evaporator 40 operating at a desired temperature. Therefore, as each particular refrigerant has its own characteristic temperature-pressure curve, it is theoretically possible to provide for frost-free operation of the evaporator 40 by setting EPRV 60 at a predetermined minimum pressure point for the particular refrigerant in use. In this manner, the refrigerant temperature within the evaporator 40 may be effectively maintained at a point at which all external surfaces of the evaporator 40 in contact with the moist air within the refrigerated space are above the frost formation temperature.

For medium temperature range refrigerated display cases, such as those commonly used for displaying milk and other diary products, conventional practice in the field of commercial refrigeration is to maintain a refrigerant temperature of about 20 degrees F and to design the evaporator heat exchanger to the refrigerated air circulating through the product chamber of the display case at a temperature between 32 to 40 degrees F. If the refrigerant temperature were instead maintained at a higher temperature, for example about 29 degrees to avoid frost formation on the evaporator heat exchanger, the temperature differential would be significantly decreased. In this case, to maintain the refrigerated air within the specified temperature range, the surface area of the evaporator heat exchanger would need to be increased to compensate for the reduced temperature head. In conventional practice, such an increase in surface area of the evaporator heat exchanger has been accompanied by a consequent, but undesirable, increase in the volume taken up by the evaporator heat exchanger.

In accordance with the present invention, the evaporator 40 comprises a high efficiency heat exchanger designed to cool the refrigerated circulation air passing from the evaporator to a temperature between 32 to 36 degrees F with a refrigerant temperature ranging from 27 to 32 degrees F, whereby the heat exchanger coil is maintained relatively frost-free or at least in a low frost formation mode. The fin and tube heat exchanger coil of the high efficiency evaporator 40 of the present invention has a relatively high fin density, that is a fin density of at least 5 fins per inch, and most advantageously in the range of 6 to 15 fins per inch. Conventional fin and tube heat exchanger coils used in forced air evaporators in the commercial refrigeration industry characteristically have a low fin density, typically having from 2 to 4 fins per inch. It has been conventional practice in the commercial refrigeration industry to use only heat exchangers of low density in evaporators for medium temperature and low temperature applications. This practice arises in anticipation of the buildup of frost of the surface of the evaporator heat exchanger and the desire to extend the period between required defrosting operations. As frost builds up, the effective flow space for air to pass between neighboring fins becomes progressively less and less until, in the extreme, the space is bridged with frost. As a consequence of frost buildup, heat exchanger performance decreases and the flow of adequately refrigerated air to the product display area decreases, thus necessitating activation of the defrost cycle.

The relatively high fin density heat exchanger coil of the high efficiency evaporator 40 of the present invention is capable of operating at a significantly lower differential of refrigerant temperature to evaporator outlet air temperature than the conventional commercial refrigeration low fin density evaporators operate at. Therefore, in accordance with the present invention, frost-free operation is possible for many medium-temperature display case applications. Additionally, in the remaining medium-temperature display case applications and in low-temperature display case applications, while truly frost-free operation may not be achieved, with application of the present invention defrost demand will be significantly reduced, whereby the time between required defrost cycles can be significantly increased.

The heat exchanger coil of the high efficiency evaporator 40 of the present invention is also more compact in volume than conventional commercial refrigeration evaporators of comparable heat exchange capacity. For example, the evaporator for the model L6D8 medium-temperature display case manufactured by Tyler Refrigeration Corporation of Niles, Mich., which is designed to operate with a refrigerant temperature of 20 degrees F. It has a fin and tube heat exchanger of conventional design having 10 rows of ⅝ inch diameter tubes having 2.1 fins per inch, providing about 495 square feet of heat transfer surface in a volume of about 8.7 cubic feet. With the high efficiency evaporator of the present invention installed in the model L6D8 case, the display case was operated in a relatively frost-free mode in accordance with the present invention. The high efficiency evaporator operated with a refrigerant temperature of 29 degrees F. In comparison to the aforedescribed conventional heat exchanger, the high fin density heat exchanger of the high efficiency evaporator has 8 rows of ⅜ inch diameter tubes having 10 fins per inch, providing about 1000 square feet of heat transfer area in a volume of about 4.0 cubic feet. Thus, in this application, the high efficiency evaporator of the present invention provides nominally twice the heat transfer surface area while occupying only half the volume of the conventional evaporator.

Although a preferred embodiment of the present invention has been described and illustrated, other changes will occur to those skilled in the art. It is therefore intended that the scope of the present invention is to be limited only by the scope of the appended claims.

What is claimed is:

1. A refrigerated medium temperature food merchandiser system having a display case including an evaporator having a fin and tube heat exchanger, a compressor, a condenser, and an expansion device upstream of and in operative association with the evaporator, all connected in a refrigeration circuit, characterized by:

an evaporator pressure control valve disposed in the refrigeration circuit downstream of and in operative association with the evaporator, the evaporator pressure control valve being set at a predetermined set point pressure for the refrigerant whereby the refrigerant has a temperature within the evaporator above about 27 degrees F; and said heat exchanger having a fin density of at least 5 fins per inch.

2. A refrigeration system as recited in claim 1, further characterized in that said heat exchanger has a fin density in the range of 6 fins per inch to 15 fins per inch.

3. A refrigeration system as recited in claim 1, further characterized in that the evaporator pressure control valve is set at a predetermined set point pressure for the refrigerant whereby the refrigerant has a temperature within the evaporator in the range of about 27 degrees F to about 32 degrees F.

4. A refrigeration system as recited in claim 3, further characterized in that said heat exchanger has a fin density in the range of 6 fins per inch to 15 fins per inch.

5. A method of operating a refrigerated merchandiser system including a display case having an evaporator having a fin and tube heat exchanger, a compressor, a condenser, and an expansion device upstream of and in operative association with the evaporator, all connected in a refrigeration circuit containing a refrigerant, characterized by:

disposing an evaporator pressure control valve in the refrigeration circuit downstream of and in operative association with the evaporator;

setting the evaporator pressure control valve at a predetermined set point pressure for the refrigerant whereby the refrigerant has a temperature within the evaporator above about 27 degrees F to about 32 degrees F; and providing said heat exchanger with a fin density of at least 5 fins per inch.

6. A method as recited in claim 5, further characterized by providing said heat exchanger with a fin density in the range of 6 fins per inch to 15 fins per inch.

7. A method as recited in claim 5, further characterized by setting the evaporator pressure control valve at a predetermined set point pressure for the refrigerant whereby the refrigerant has a temperature within the evaporator in the range of about 27 degrees F to about 32 degrees F.

8. A method as recited in claim 7, further characterized by providing said heat exchanger with a fin density in the range of 6 fins per inch to 15 fins per inch.

* * * * *